US005123128A

United States Patent [19]

Hines

[11] Patent Number: 5,123,128

[45] Date of Patent: Jun. 23, 1992

[54] BATHTUB STRUCTURE INCORPORATING ENCLOSURE SUPPORT COLUMNS AND ROLLABLY SUSPENDED ENCLOSURE PANELS

[76] Inventor: James S. Hines, 2231 Tangerine St., Sparks, Nev. 89431

[21] Appl. No.: 594,628

[22] Filed: Oct. 9, 1990

[51] Int. Cl.[5] ..... E05D 13/00; E06B 7/00

[52] U.S. Cl. ..... 4/557; 4/610; 49/411; 49/463; 16/95 R

[58] Field of Search ..... 4/557, 607, 610, 538; 49/404, 411, 463; 16/95 R

[56] References Cited

U.S. PATENT DOCUMENTS

| | | | |
|---|---|---|---|
| 3,074,077 | 1/1963 | Taubman | 4/607 |
| 3,359,573 | 12/1967 | Casebolt | 4/607 |
| 3,422,464 | 1/1969 | O'Brien . | |
| 3,650,071 | 3/1972 | Tanner | 49/404 |
| 3,744,827 | 7/1973 | Cox | 49/411 X |
| 3,896,508 | 7/1975 | Doan | 4/557 |
| 4,258,443 | 3/1981 | Baus . | |
| 4,358,863 | 11/1982 | Jacobsen | 4/610 |
| 4,445,239 | 5/1984 | Jacobsen | 4/610 X |
| 4,672,694 | 6/1987 | Dusar | 49/411 X |
| 4,829,608 | 5/1989 | Stevens et al. . | |
| 4,887,394 | 12/1989 | Marlowe | 49/409 |

*Primary Examiner*—Daniel M. Yasich
*Attorney, Agent, or Firm*—John J. Leavitt

[57] ABSTRACT

A monolithic bathtub structure incorporates vertical support columns that in one aspect are integral with the bathtub and which can be secured directly to the stud framing of the cubicle in which the bathtub is installed. The bathtub structure includes a suspension beam incorporating a locking mechanism to prevent inadvertent release of the access panels from the assembly, yet the locking mechanism may be adjusted to permit removal of the access panels. In other aspects of the invention, the suspension beam, including the panel locking mechanism, and the support columns may be independently manufactured as component parts to be assembled by the purchaser to form a bathtub enclosure. The monolithic bathtub structure is capable of formation from an appropriate synthetic resinous material, as are the support columns.

17 Claims, 4 Drawing Sheets

BATHTUB STRUCTURE INCORPORATING ENCLOSURE SUPPORT COLUMNS AND ROLLABLY SUSPENDED ENCLOSURE PANELS

BACKGROUND OF THE INVENTION

1. Field of the Invention

This invention relates to bathtub enclosures, and particularly to such a structure that is molded as a single monolithic unit from synthetic resinous material.

2. Description of the Prior Art

A preliminary patentability and novelty search was conducted in connection with the subject matter of this invention in Class 4, sub-classes 557, 584, 607, 610, 612, and 614; and Class 49, sub-classes 411, 452, 454 and 456.

As a result of the search in the area indicated, six patents as follows were found:

| | | |
|---|---|---|
| 3,896,508 | 4,258,443 | 3,422,464 |
| 4,445,239 | 4,672,694 | 4,829,608 |

In conventional bath enclosures, including shower stalltype enclosures, it is a common practice to utilize a framework of metal channels to support the sliding glass door panels that give access to the interior of the tub enclosure or the shower stall. Conventionally, the vertical risers at opposite ends of the tub are metal channels anchored to the underlying tile or wall board and against which the vertical edges of the sliding glass panels may abut, while the top member or beam that extends between the two vertical risers or support columns provides a guideway and frequently a suspension means for the sliding glass door panels. In like manner, in many conventional tub and shower stall enclosure units, the lower rail is secured along the top edge of the tub, for instance, and serves to guide or support the lower end of the sliding glass panels. This construction is most usually applied t the wall structures after the wall structures have been tiled so that it becomes an "add on" structure.

It is one of the important objects of this invention to provide a monolithic molded bathtub incorporating integral vertical support columns or risers that are adapted to be attached to the underlying framework that defines the cubicle within which the monolithic molded tub is inserted prior to the application of ceramic tile or other suitable finish material.

Another object of the invention is the provision of a monolithic structure including a wall portion and a tub portion, molded together in a manner adapted to enable direct application of the wall portion of the unit to the vertical stud or framing members that define the cubicle in which the monolithic bathing unit is installed.

One of the difficulties encountered in most tub enclosures or bathing units, whether it be a one piece tub surround and tub ensemble, or a shower stall enclosure, is the matter of cleanliness of the tub or shower stall. One of the factors that makes cleanliness a difficult parameter to achieve in these type units is the fact that soapy water collecting on the surfaces, if not cleaned or dried promptly, tends to grow mold, thus being unsightly and odoriferous. The trapping of water occurs most generally in the tracks within which the bottom edges of the sliding glass door panels in a tub enclosure or shower stall are captured or guided, and which are very difficult to clean because of the closely spaced upstanding flanges that are utilized to capture the lower end edge portions of the glass door panels. Accordingly, another object of the invention is the provision of a bathing unit, whether it be a monolithic bathtub ensemble or a shower stall in which the conventional rails fastened along the top edge of the tub or at the entrance to the shower stall are eliminated to prevent the capture and retention of water, thus facilitating cleaning of the tub or shower stall and eliminating the growth of mold.

Conventional bathtub enclosures and shower stall enclosures frequently utilize entry doors that slide or roll horizontally on tracks supported beneath the lower edges of the doors, or which enclose the upper edges of the doors and provide tracks from which the doors may be suspended. In either case, there is a problem with the security of the door, it being relatively easy to lift the doors out of their respective channels, thus giving rise to the possibility of injury should one of the doors be inadvertently released from its guide track. Accordingly, a still further object of the invention is the provision of means for suspending horizontally rollable access door panels in either a tub enclosure or a shower stall wherein the doors may be locked against inadvertent removal while permitting them to roll horizontally to give access to the interior of the tub enclosure or stall shower, while enabling the door panels to be unlocked for intentional removal.

Another object of the invention is the provision of a monolithic one-piece bathtub including means molded directly into one wall of the tub which functions as a support for a short channel guide to guide the lower edge of horizontally rollable access doors and which automatically drains water back into the tub, and is completely exposed to facilitate cleaning.

The invention possesses other objects and features of advantage, some of which, with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the monolithic bathing unit forming the subject matter of the invention in one aspect comprises a tub portion and a tub surround portion, the two portions being molded integrally so that there is no possibility of water leaking from the bathing unit. The tub surround portion is designed to fit snugly against the vertical stud members that define the cubical into which the bathing unit is to be installed, thus enabling securement of the bathing unit to the superstructure of the house in a manner not heretofore possible. The tub surround portions include vertical support columns or risers provided at opposite ends of the tub, and each lies in a plane generally associated with the plane of the front wall of the tub portion. A channel is formed in each vertical support column or riser, providing an elongated recesses into which the vertical edges of the juxtaposed door panels may extend to prevent inadvertent passage of water around the doors or access panels. Means are also provided to suspend the access panels in a manner that prevents their inadvertent dislodgement, and means are also provided forming a guide for the lower edges of the door panels, constructed in such a way that water runs away from the bottom edges of the doors back into the tub, and exposing the lower support member so that it may be dried and remain mold-free.

DESCRIPTION OF THE PREFERRED EMBODIMENT

In terms of greater detail, the bathing unit forming the subject matter of this invention comprises in a preferred form a one-piece monolithic bathtub structure that includes a tub associated integrally with a tub surround wall portion, the bathing unit, including the tub surround wall portion, being molded from an appropriate synthetic resinous material, the tub surround wall portion including two vertical support columns that are adapted to be attached directly to the wall studs defining the cubicle into which the bathing unit is to be installed.

Figure 1:
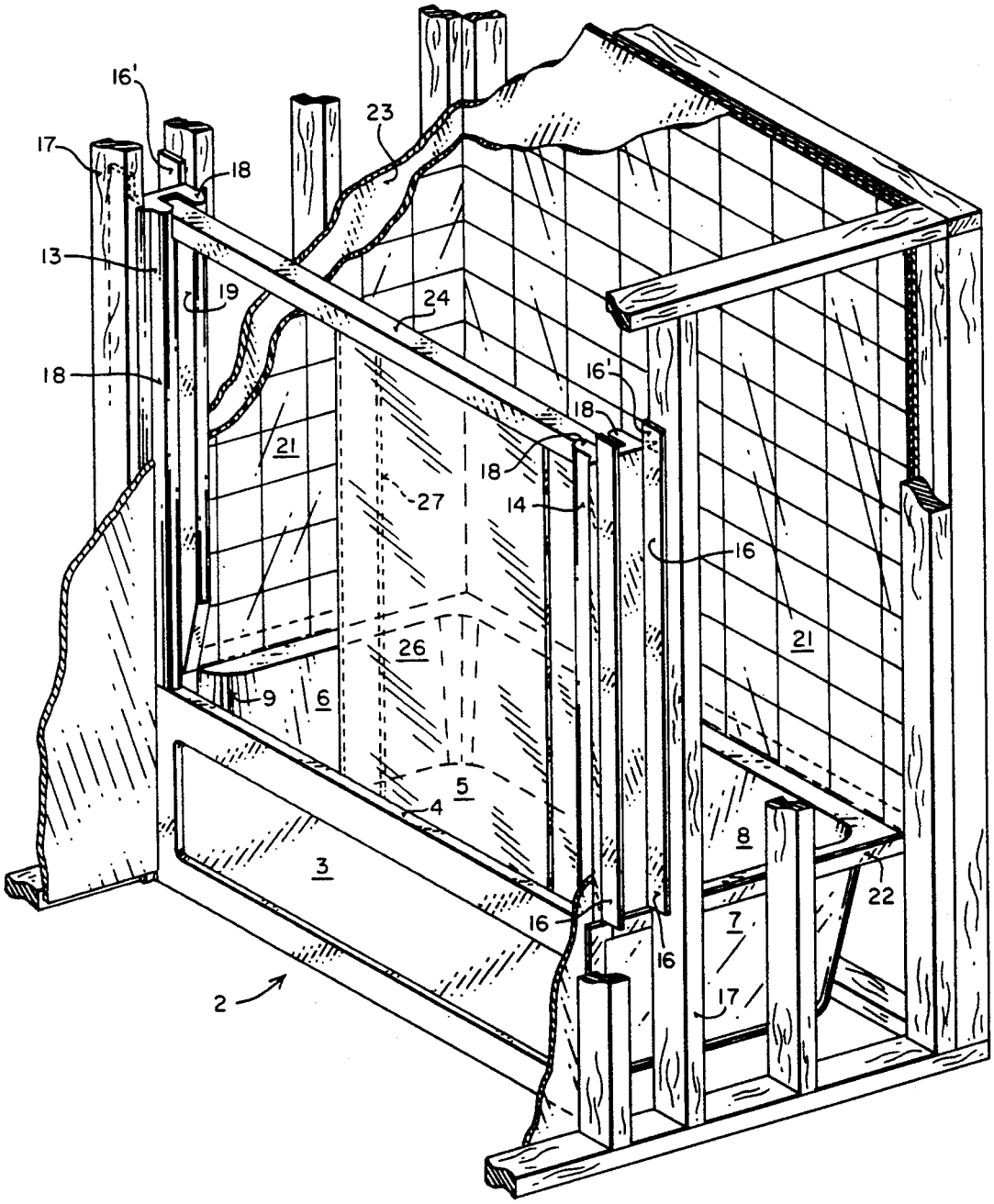
FIG. 1 is a fragmentary perspective view illustrating the bathing unit of the invention installed in a cubicle in relation to the vertical studs that define the cubicle. Portions of the structure are broken away to reveal underlying parts.
Figure 2:
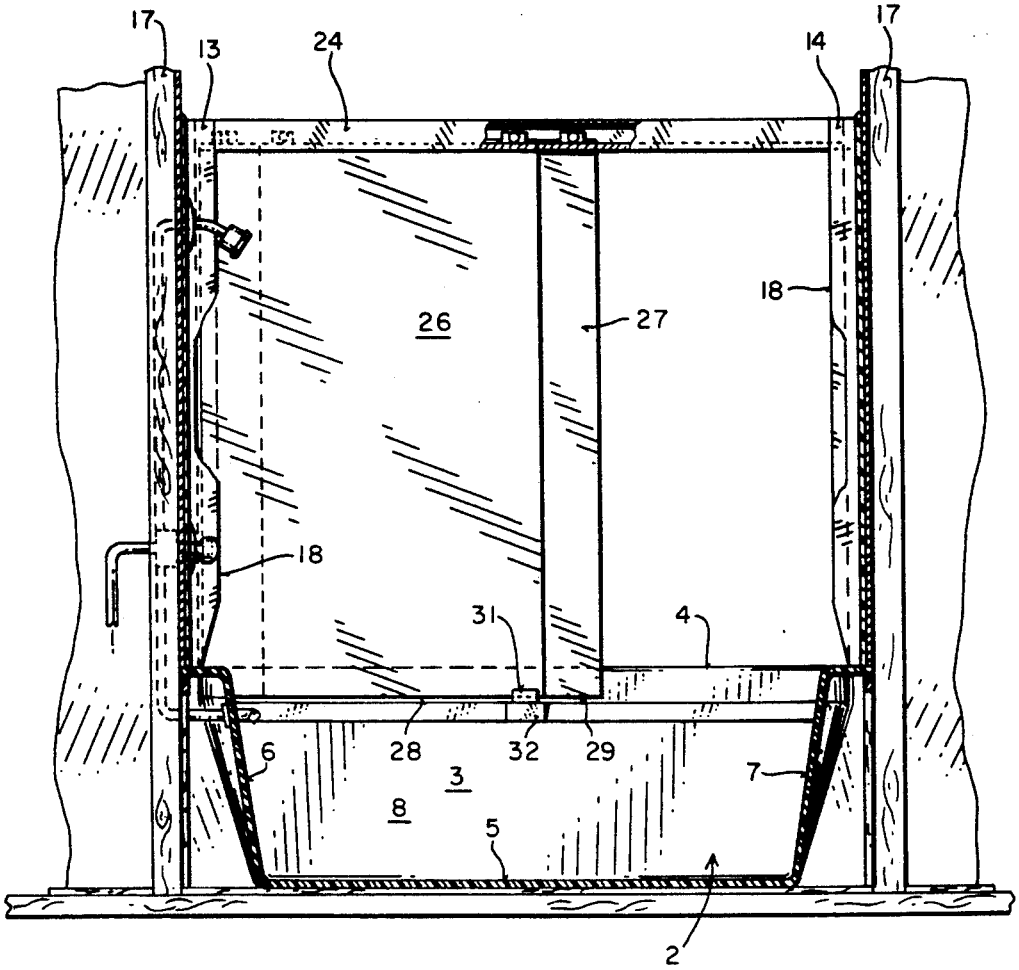
FIG. 2 is a vertical cross-sectional view through the longitudinal dimension of the bathing unit.
Figure 3:
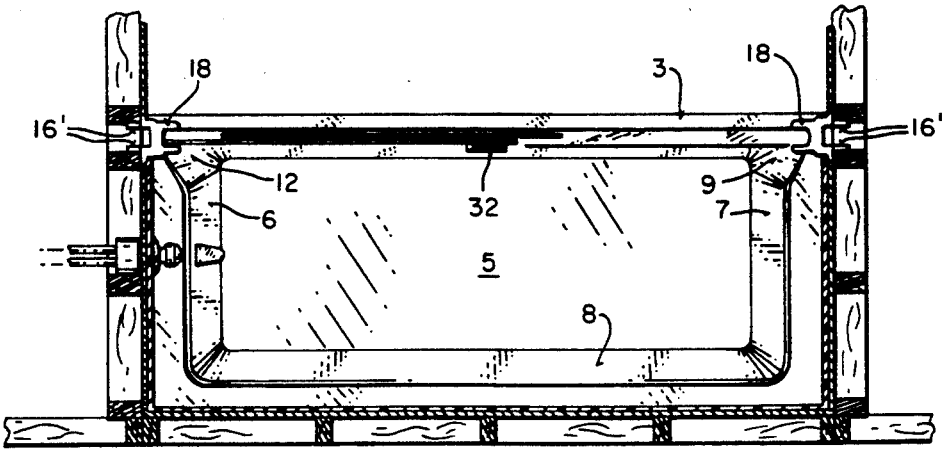
FIG. 3 is a horizontal sectional view illustrating the tub in plan.
Figure 4:
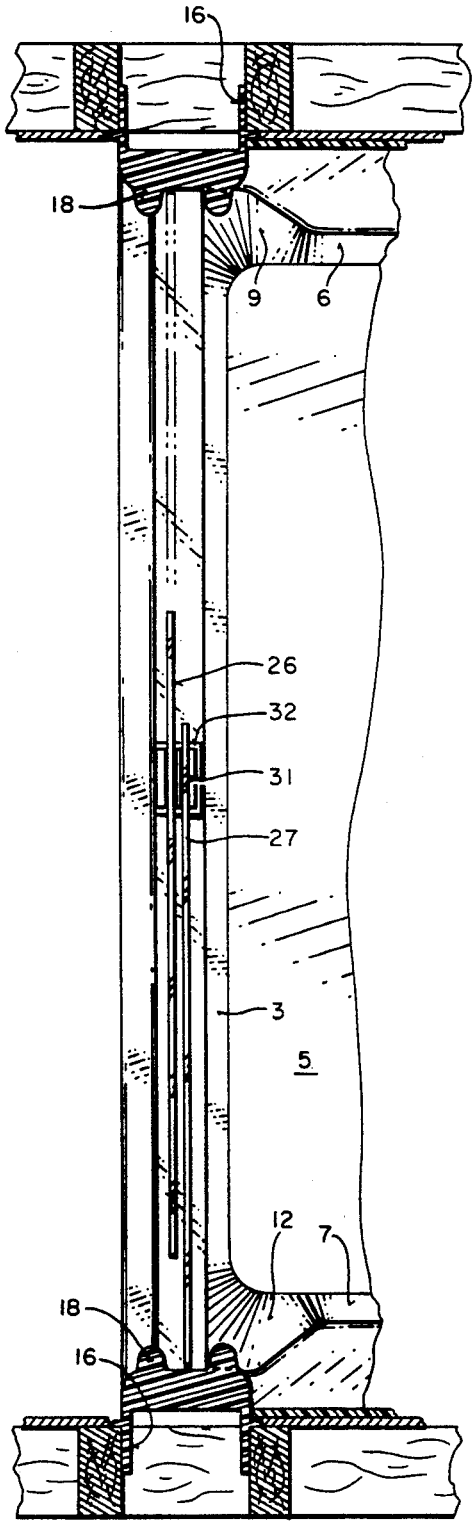
FIG. 4 is a fragmentary horizontal sectional view taken above the top wall of the tub, showing the end support columns in section and the underlying bathtub in plan.
Figure 5:
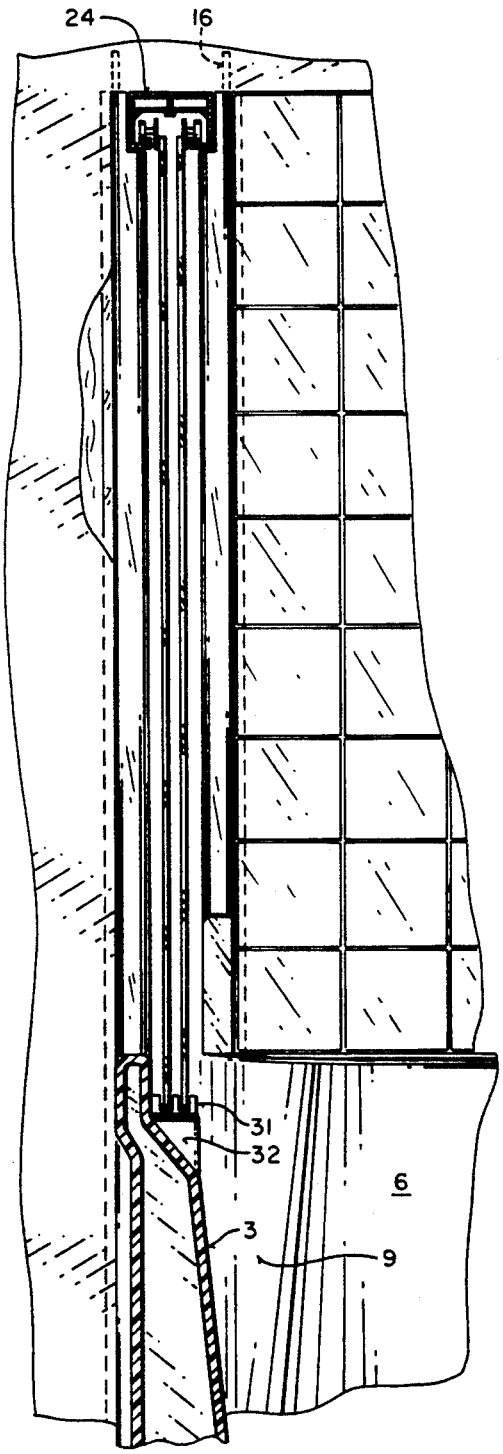
FIG. 5 is a vertical sectional view illustrating the means for mounting the sliding access panels in relation to the bathing unit.

In more specific detail, and referring to FIG. 1, it will there be seen that in this embodiment there is provided a tub formed from a synthetic resinous material and designated generally by the numeral 2, formed with a front wall 3, having a top edge 4, a bottom wall 5, and molded integrally with end walls 6 and 7 as shown. As illustrated in FIGS. 1 and 3, the bottom wall 5 and end walls 6 and 7 are joined integrally by a rear wall 8 and by the front wall 3. Associated with opposite ends of the front wall, the jointure of each end wall 6 and 7 to the front wall is provided with vertically extending recesses 9 and 12 that are intercepted by the top and bottom walls for purposes which will hereinafter be explained.

In the embodiment illustrated in FIG. 1, the front wall 3 at each opposite end is provided with a pair of integral support columns 13 and 14, constituting channel members, each of the channel members including, rearwardly extending flanges 16 adapted to be fastened securely to the vertical studs 17 that form a part of the vertical framing members that define the cubicle into which the bath unit is installed. The flanges 16 at their upper ends preferably extend beyond the upper ends of the channels in tab portions 16'. It should of course be understood that instead of the flange 16 extending the full length of the channel members, it may be divided along its length to project a multiplicity of separate tabs 16' spaced longitudinally along the channels. The pair of spaced vertical channel members or support columns are also provided with mutually facing ribs or flanges 18, the ribs on each vertical channel member being spaced laterally to define a channel 19 therebetween for purposes which will hereinafter be explained. The lower end of each of the upright channel members 13 and 14 are preferably integrally joined to the corner formed at the opposite ends of the front wall 3 by the integral jointure of the end walls and front wall, and extend vertically upwardly perpendicular to the top edge 4 of the front wall. Alternatively, the channel members 13 and 14 may be separate units that are applied to the studs 17 defining the cubicle into which the bath unit is to be installed after the bathtub is installed and, in either event, prior to installation of wall board enclosing the cubicle or tile applied to such wall board enclosing the cubicle. Obviously, where appropriate, in a third embodiment, the bath unit may be constructed so that the tub, the vertical channel members 13 and 14, and the tub surround 21, here shown as being ceramic tile, may be molded as one monolithic integral unit adapted to be inserted into the cubicle formed by the framing members. Where the tub 2 is molded as a separate unit apart from the surround 21, the end walls 6, 7 and backwall 8 are provided with an upwardly extending flange 22 which abuts the framing members 17 when the bath unit is inserted into the cubicle prior to application of the tile backing for instance, or abuts against the tile backing 23 when the cubicle into which the bath unit is adapted to be installed is lined prior to application of the tub surround 21, whether that tub surround be synthetic resinous sheets formed to fit the end and back walls of the cubicle, or separate ceramic tiles applied to the wall to make the cubicle surrounding the tub impervious to water.

Figure 6:
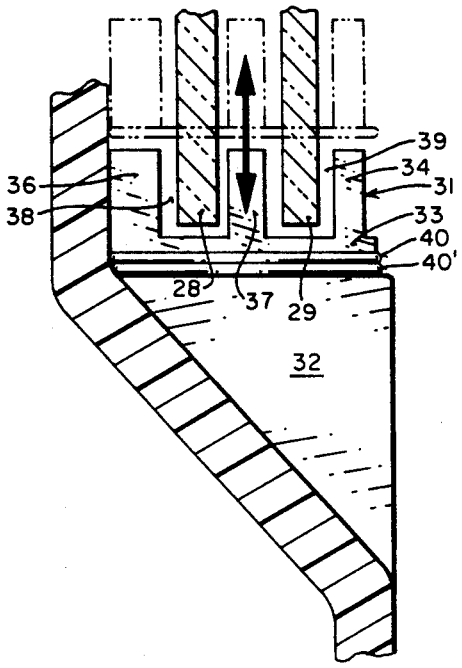
FIG. 6 is an enlarged fragmentary vertical sectional view illustrating the means for guiding the lower edges of the access panels.

Again referring to FIG. 1, it will be seen that the vertical support columns 13 and 14 are connected at their upper ends by a longitudinally extending beam 24 detachably secured at each opposite end to the support column members 13 and 14. The beam is adapted to form a suspension track for a pair of relatively rollable access panels 26 and 27, suspended so that their weight is carried by the beam 24, and suspended so that the lower edges 28 and 29 of the access panels 26 and 27, respectively, extend below the top edge 4 of the front wall 3, where they are retained in a vertical relationship yet permitted to move relative to each other in a horizontal direction by a short retainer channel 31 mounted on a short ledge 32 molded on the inside of the front wall 3 of the tub below the top edge 4 thereof as illustrated in FIGS. 2, 3, 4, 5, and 6. Referring to FIG. 6, the channel member 31 is provided with a base 33 from which extend integral outer flanges 34 and 36 and a central flange 37, the flanges 34, 36 and 37 defining channels 38 and 39 separated by the flange 37 so that the lower end edge portions 28 and 29 of the panels extend into the channels 38 and 39, respectively, to maintain the panels in spaced parallelizm. Preferably, the short retainer channel 31 is formed from synthetic resinous material and is provided with an underlying ferrous metal plate 40 that cooperates with a plate magnet 40' secured to the ledge to magnetically retain the channel on the ledge 32, thus permitting the channel 31 to be removed for cleaning purposes.

Figure 8:
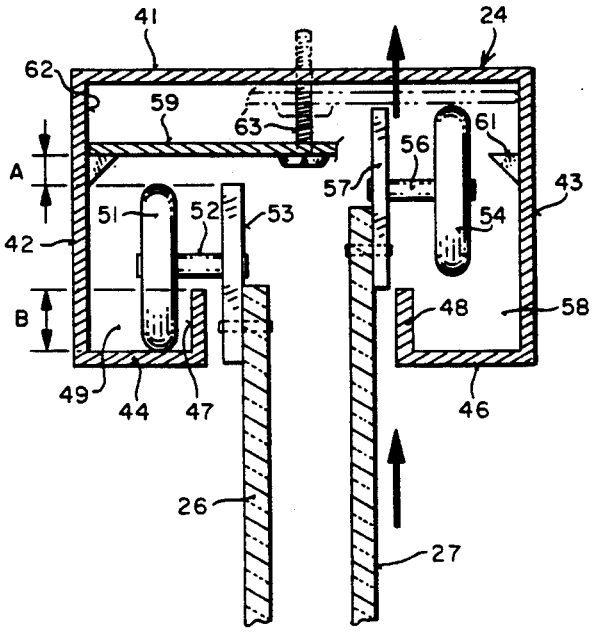
FIG. 8 is a fragmentary cross-sectional view illustrating the suspension beam for the access panels, and the means for locking the panels against inadvertent release.

To suspend the access panels 26 and 27 from the support beam 24, the support beam is configured as illustrated in FIG. 8, constituting an elongated channel member having a top web 41, and downwardly extending lateral flanges or side walls 42 and 43, the lower edges of the lateral side flanges 42 and 43 are connected integrally with inwardly extending flanges 44 and 46 forming a bottom wall, the flanges 44 and 46 provided, respectively, with reentrant flanges 47 and 48 as shown that define an elongated slot therebetween. The lateral side flange 42, inwardly extending bottom flange 44 and reentrant flange 47, form an elongated track or guideway 49 within which is rollably disposed a roller 51 journaled on an axle 52 which is in turn fixed on a bracket 53 appropriately attached to the top edge portion of the access panel 26 as shown.

With regard to the access panel 27, this panel is also provided with a roller 54 journaled on an axle 56 fixedly secured to a bracket 57 mounted to the top ridge portion of the access panel 27. As with the access panel 26, the roller assembly 54, 56 and 57 cooperates with the reentrant flange 48, bottom flange 46 and downwardly extending lateral flange 43 to form a channel 58 within which the roller 54 may rollably traverse the length of the support member 24. It will thus be seen that the panels 26 and 27 are rollably suspended from their top edge portions from the beam 24, and their lower edge portions are guided by the channel member 31.

One of the problems that occurs with conventional access panels in bathtubs and shower stalls is that the panels may inadvertently be lifted from their suspension tracks and create the danger of being broken by coming into contact with hard surfaces, such as the tile walls or the tub. To prevent the inadvertent release of the panels 26 and 27, there is provided within the elongated channel member 24 a transversely extending retention plate 59 supported on angle brackets 61 secured to the inner surface 62 of the lateral flanges 42 and 43 as shown, so that in the position illustrated in FIG. 8 in full lines with reference to the access panel 26, the retention plate 59 extends the full length and width of the support beam 24, and is provided at least adjacent each opposite end, and where necessary at intervals along the length thereof, with adjustment screws 63 threaded in an appropriately threaded bore in the top wall 41 as shown, and adjustable to retain the retention plate 59 in the position illustrated on the left of FIG. 8 associated with the roller 51, thus preventing the roller from being raised sufficiently to clear the top edge of the reentrant flange 47 and thus locking the roller within its channel and locking the panel against inadvertent release. Stated another way, in the position illustrated in FIG. 8 in full lines, the retention or lock plate 59 provides a space between the lower surface of the retention plate 59 and the top periphery of the roller 51 equal to the dimension A indicated to the left of the figure. This dimension is less than the dimension B, also illustrated at the left of the figure and being equal to the height of the reentrant flange 47. Once the lock or retention plate 59 is adjusted to establish the dimension A, the panels are locked against inadvertent release. However, when it is desired to remove the panels 26 and 27 from the assembly, all that is required is that the screw assemblies 63 be manipulated so as to elevate the retention plate 59 so that it lies next adjacent the web 41, thus increasing the dimension A to an amount greater than dimension B so as to provide clearance for the rollers 51 and 54 to clear the top edges of the reentrant flanges 47 and 48 as shown on the right of FIG. 8 ,with reference to the access panel 27. This alternate unlocked position of the retention plate 59 is shown in broken lines on the right side of FIG. 8. Thus, in this "released" position of panel 27, elevation of the panel in the direction of the arrow, with subsequent lateral translation toward the panel 26, will cause the roller 54 to pass over the reentrant flange 48. Elevation of the panel will also result in the bottom edge portion 29 of the panel 27 clearing the top edge of the flange 34 of channel member 31, thus enabling the panel to be removed completely from the tub assembly.

Figure 7:
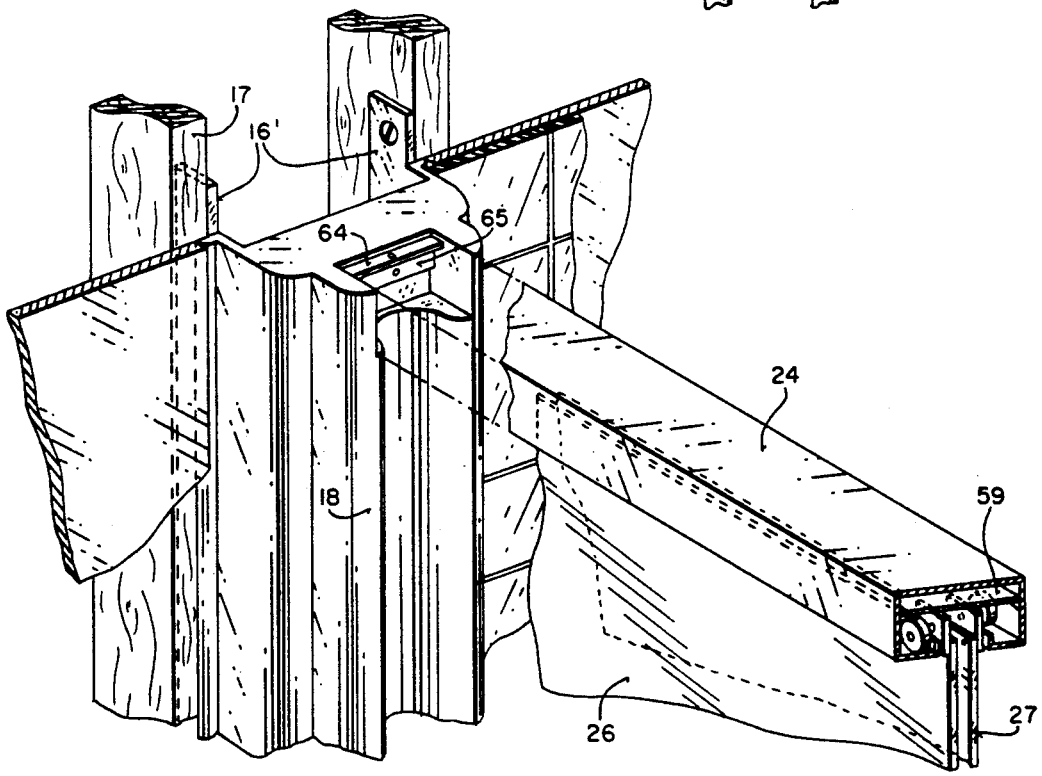
FIG. 7 is an enlarged fragmentary perspective view illustrating the relationship between an end support column and the horizontal support member for the access panels.

It will thus be seen that the bathing unit, manufactured as a monolithic assembly, including the tub and the tub surround, and including also the vertical uprights 13 and 14, may be slipped snugly into the cubicle framed for it in a residence and snugly locked in place by fastening the flanges 16 and/or flange extensions 16' to the associated studs of the framing that defines the cubicle. When the upright support columns 13 and 14 are molded integrally with the tub and tub surround, the monolithic assembly is inserted into the cubicle before application of the vertical studs 17 as illustrated in FIG. 1. Following insertion of the monolithic bath assembly into its cubicle, and following attachment of the flanges 16 and/or extension tabs 16' to the associated stud to retain the assembly in position, the stud 17 is applied so that the pair of flanges 16 that protrude rearwardly from each of the rear faces of the support columns 13 and 14 lie captured between the laterally spaced studs to not only capture the bath assembly and retain it in its installed position, but also to provide back-up support for the vertical channel members 13 and 14. Once the vertical support columns 13 and 14 are secured to the studs, the longitudinally extending support beam 24 may be installed, the channel members 13 and 14 being provided with an appropriate angle bracket 64 (FIG. 7), the downwardly extending flange 65 being detachably secured to the inner face of the upright support columns 13 and 14 by an appropriate screw, while the remaining right angle flange forms a seat and a support to which the beam 24 may be detachably secured by an appropriate screw as illustrated in FIG. 7.

It will thus be seen that this construction eliminates the elongated metal angle members that are conventionally fastened to the top edge of a tub or shower stall enclosure and which make it very uncomfortable for a bather to sit on the top edge of the tub while drying himself after the bath, and which also form a retention chamber for soapy water which is difficult to clean and which frequently remains in the channel for long periods of time, tending to promote the growth of mold. Also to be considered is the contoured recesses 9 and 12 at each end of the front wall of the bathtub which funnel water back into the bathtub, where it runs into the drain, the contoured corners also providing clearance for closing of the access panels within the recesses formed in the vertical support columns.

Having thus described the invention, what is believed to be new and novel and sought to be protected by letters patent of the United States is as follows.

I claim:

1. A bathtub structure adapted to be inserted into a cubicle defined by end walls connected by a side wall, said end walls including wall framing members, comprising:

a) a bathtub having opposite end and side walls joined by a bottom wall, one of said side walls constituting the front wall of the bathtub over the upper surface of which access is had to the bathtub by a bather;

b) a pair of spaced support columns, each support column of the pair having upper and lower ends, said lower ends cooperatively associated with opposite ends of said front wall of the bathtub and each support column rising vertically therefrom in cooperative juxtaposition with an associated end wall of said cubicle;

c) a beam connecting the upper ends of said support columns and therewith and with said front wall of the bathtub defining an access opening into the bathtub for a bather;

d) at least one access panel having upper and lower edge portions, said upper edge portions suspended on said beam and translatable to open or close said access opening, said lower edge portion of said at least one access panel extending into the tub below the upper surface of said front wall of said bathtub; and e) means mounted on said beam adjustable to normally retain said access panel translatably suspended on said beam to prevent inadvertent release thereof from said beam while not restricting lateral translation thereof.

2. The combination according to claim 1, wherein said front wall of said bathtub possesses an inside surface and an outside surface, and guide means are provided on said inside surface of the bathtub below said upper surface thereof to guide translation of said access panel.

3. The combination according to claim 2, wherein means are mounted on said beam adjustable to rollably lock the upper edge portion of said access panel to said beam and the lower edge portion thereof in said guide means to prevent inadvertent release of said panel from said beam and said guide means.

4. The combination according to claim 1, wherein said bathtub and said support columns are fabricated from synthetic resinous material.

5. The combination according to claim 1, wherein each of said support columns comprises an elongated member having front and rear faces and having oppositely extending flanges extending from said front and rear faces thereof and a pair of oppositely extending flanges extending perpendicular to said front and rear faces for mounting said support columns to said end walls of said cubicle.

6. The combination according to claim 5, wherein said bathtub and said support columns are fabricated from synthetic resinous material.

7. The combination according to claim 6, wherein said bathtub and said support columns are integrally formed one with the other.

8. The combination according to claim 5, wherein said flanges extending from said front faces of said support columns define a channel for receiving an associated edge of the at least one access panel, the flanges extending from the rear faces of said support columns are secured to faces of said wall framing members perpendicular to said end walls, and said flanges extending perpendicular to said front and rear faces of said support columns are secured to faces of said framing members parallel to said end walls, whereby said support columns are securely anchored to said framing members.

9. The combination according to claim 1, wherein said bathtub and said support columns are integrally formed one with the other.

10. The combination according to claim 1, wherein said beam connecting said spaced support columns comprises an elongated metal member having a generally rectangular box-like cross-section including spaced upper and lower walls connected by spaced side walls defining a hollow interior, said bottom wall including an elongated longitudinally extending slot defined by spaced and parallel re-entrant flanges each defining with its associated side wall a trackway within said beam, means mounted on the upper edge portion of said at least one access panel rollably supporting said access panel on said trackway for selective translation therealong, and means mounted on said beam adjustable to rollably lock said access panel to said beam to prevent inadvertent release therefrom.

11. The combination according to claim 1, wherein said beam is detachably secured to the upper ends of said support columns.

12. An enclosure assembly for a bathtub adapted to be inserted into a cubicle defined by end walls connected by a side wall, said end walls including wall framing members, comprising:

a) a pair of spaced support columns, each support column of the pair having upper and lower ends, said lower ends adapted to be cooperatively associated with opposite ends of the front wall of a bathtub, each support column when installed rising vertically from the bathtub in cooperative juxtaposition with the associated end wall of the cubicle;

b) a beam detachably connecting the upper ends of said support columns, said beam comprising an elongated metal member having a generally rectangular box-like cross-section including spaced upper and lower walls connected by spaced side walls defining a hollow interior, said bottom wall including an elongated longitudinally extending slot defined by spaced and parallel reentrant flanges each defining with an associated side wall a trackway within said beam;

c) at least one access panel having upper and lower edge portions and suspended by said upper edge portion on said beam and translatable therealong; and d) means mounted on said beam adjustable to normally retain said access panel translatably suspended on said beam to prevent inadvertent release thereof from said beam while not restricting lateral translation thereof.

13. The enclosure assembly as defined in claim 12, wherein said access panel is rollably translatable on said beam.

14. The enclosure assembly as defined in claim 12, wherein said means mounted on said beam to lock said access panel to said beam to prevent inadvertent release thereof comprises a flat elongated plate mounted within the beam between the upper edge portion of the access panel and the upper wall of the beam and selectively adjustable between a lower position in which the plate prevents elevation of the access panel sufficiently to release the access panel from the beam and an upper position that allows elevation of the access panel sufficiently to release the access panel.

15. The enclosure assembly as defined in claim 12, wherein each support column of said pair thereof comprises an elongated member having front and rear faces and flanges extending perpendicularly from said front and rear faces and a pair of oppositely extending flanges extending parallel to said front and rear faces, said flanges extending from said rear face and said oppositely extending flanges parallel to said front and rear faces adapted for attachment of said support column to the supporting wall framing members of said cubicle.

16. The enclosure assembly as defined in claim 15, wherein each support column is formed from synthetic resinous material.

17. As an article of manufacture, a suspension beam adapted to translatably support access panels of a bathtub enclosure assembly which also includes a pair of laterally spaced support columns between which the access panels are translatable to open or close an access opening to the bathtub enclosure, the suspension beam comprising:

a) an elongated member having a generally rectangular cross-section including spaced upper and lower walls connected by spaced side walls to define a hollow interior;

b) an elongated longitudinally extending slot formed in said lower wall;

c) a pair of laterally spaced reentrant flanges extending into said hollow interior of said suspension beam along opposite edges of said slot, each said reentrant flange defining with an associated side wall a trackway within said beam on which an access panel is adapted to be translatably supported for movement along the beam; and d) means mounted within said beam operatively associated with said reentrant flanges and adjustable to selectively retain an access panel translatably suspended on said trackway against inadvertent removal therefrom while not restricting movement along the beam or adjustability to release the access panel for removal from said trackway.

* * * * *